US010623873B2

(12) United States Patent
Flaig et al.

(10) Patent No.: US 10,623,873 B2
(45) Date of Patent: Apr. 14, 2020

(54) HEARING DEVICE

(71) Applicant: SIVANTOS PTE. LTD., Singapore (SG)

(72) Inventors: Uwe Flaig, Feucht (DE); Hartmut Ritter, Neunkirchen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/171,701

(22) Filed: Oct. 26, 2018

(65) Prior Publication Data

US 2019/0132690 A1 May 2, 2019

(30) Foreign Application Priority Data

Nov. 2, 2017 (DE) ..... 10 2017 219 470

(51) Int. Cl.
*H04R 25/00* (2006.01)
*H04R 1/08* (2006.01)
*H04R 25/02* (2006.01)

(52) U.S. Cl.
CPC ..... *H04R 25/65* (2013.01); *H04R 1/086* (2013.01); *H04R 25/02* (2013.01); *H04R 25/402* (2013.01); *H04R 25/604* (2013.01); *H04R 25/654* (2013.01); *H04R 25/60* (2013.01); *H04R 2225/021* (2013.01); *H04R 2460/17* (2013.01)

(58) Field of Classification Search
CPC ..... H04R 25/60; H04R 25/604; H04R 25/65; H04R 25/652; H04R 25/654; H04R 2225/021; H04R 2225/025; H04R 2460/17
USPC ..... 381/322, 324, 325, 328, 329, 330
See application file for complete search history.

(56) References Cited

U.S. PATENT DOCUMENTS

| | | | | |
|---|---|---|---|---|
| 4,739,512 | A * | 4/1988 | Hartl | H04R 25/65 381/324 |
| 4,987,597 | A * | 1/1991 | Haertl | H04R 25/654 381/325 |
| 5,530,763 | A * | 6/1996 | Aebi | H04R 25/652 381/322 |
| 7,372,973 | B2 * | 5/2008 | Meier | H04R 25/65 381/330 |
| 8,233,649 | B2 | 7/2012 | Gebert et al. | |
| 8,355,519 | B2 | 1/2013 | Gommel et al. | |
| 8,542,858 | B2 | 9/2013 | Flaig et al. | |
| 10,200,799 | B2 | 2/2019 | Flaig et al. | |
| 2015/0271610 | A1 * | 9/2015 | Vandyke | H04R 25/60 381/322 |
| 2016/0337764 | A1 * | 11/2016 | Flaig | H04R 25/604 |

FOREIGN PATENT DOCUMENTS

| | | | |
|---|---|---|---|
| DE | 102010014954 | A1 | 10/2011 |
| DE | 102015208846 | B3 | 8/2016 |
| EP | 2157815 | A1 | 2/2010 |

(Continued)

*Primary Examiner* — Huyen D Le
(74) *Attorney, Agent, or Firm* — Laurence A. Greenberg; Werner H. Stemer; Ralph E. Locher

(57) ABSTRACT

A hearing device has a sealable housing with a wall that delimits an inner space. In addition, the hearing device has a microphone which is arranged in the inner space, and a microphone opening in the wall, as well as a protective element for protecting the microphone. The housing has a sound channel with at least one sound inlet opening, and the protective element is positioned in the sound channel.

14 Claims, 3 Drawing Sheets

(56) References Cited

FOREIGN PATENT DOCUMENTS

| | | | |
|---|---|---|---|
| EP | 2334102 | A2 | 6/2011 |
| EP | 2360948 | A2 | 8/2011 |
| EP | 2823648 | B1 | 3/2016 |

* cited by examiner

HEARING DEVICE

CROSS-REFERENCE TO RELATED APPLICATION

This application claims the priority, under 35 U.S.C. § 119, of German application DE 10 2017 219 470.7, filed Nov. 2, 2017; the prior application is herewith incorporated by reference in its entirety.

BACKGROUND OF THE INVENTION

Field of the Invention

The invention relates to a hearing device, in particular an in-the-ear (ITE) hearing device having the features of the preamble of the main claim.

Hearing devices are wearable hearing apparatuses that are generally configured to output sound. "Sound" here generally signifies an acoustic signal, for example music and/or speech.

A "hearing apparatus" generally refers to any device which may be worn in or on the ear and produces a sound, for example a headset, headphones and the like. Hearing devices are, in addition, specially designed as hearing aids. "Hearing aid" refers to a device for the care of a person with hearing loss or a hearing impairment who, in particular, wears the hearing aid continuously or most of the time in order to compensate for a hearing deficit.

Hearing devices generally have as their main components an input transducer, an amplifier and an output transducer. The input transducer is usually a sound receiver, e.g. a microphone, and/or an electromagnetic receiver, e.g. an induction coil. The output transducer is usually realized as an electroacoustic transducer, e.g. miniature speaker, or as an electromechanical transducer, e.g. bone conduction receiver. The amplifier is typically integrated into a signal processing unit. This general structure is shown in FIG. 1 using the example of a behind-the-ear hearing device. One or more microphones 2 for recording the sound from the environment are built into a hearing device housing 1 to be worn behind the ear. A signal processing unit 3, which is also integrated into the hearing device housing 1, processes and amplifies the microphone signals. The output signal of the signal processing unit 3 is transmitted to a loudspeaker or receiver 4, which outputs an acoustic signal. The sound is optionally transmitted to the device wearer's eardrum via a sound tube, which is fixated in the ear canal by an earmold. The power supply for the hearing device and in particular the signal processing unit 3 is accomplished via a battery 5 that is likewise integrated into the hearing device housing 1.

For sound that is amplified, for example, a voice of a conversation partner of the hearing device wearer typically passes to the microphone via one or more sound openings in the hearing device housing. However, undesired foreign bodies and/or liquids such as water and/or sweat may enter the interior of the hearing device and in particular the microphone through such sound openings. This may lead to damage to the microphone or even to failure of the hearing device.

Published, European patent application EP 0 310 866 A1 discloses an apparatus for sealing openings on hearing devices. The openings are sealed for example by means of caps that have a sound-permeable and moisture-repellent membrane. To seal the openings, the caps are for example screwed onto the opening.

SUMMARY OF THE INVENTION

Proceeding from this, the objective of the invention is to provide a hearing device in which the openings, in particular the microphone opening, are reliably protected.

The objective is achieved according to the invention by a hearing device with the features of the main claim. Advantageous configurations, developments and variants are the subject matter of the dependent claims.

The hearing device has a normally sealable housing with a wall. "Sealable" herein means that the housing is in particular not built in one piece, i.e. monolithically, but instead has at least two (housing) parts, and the housing may be opened, for example, for a battery replacement and/or the replacement of defective parts. The wall delimits an inner space, and preferably the above-mentioned individual components of the hearing device are arranged in this space.

Thus, the hearing device has a microphone arranged in the inner space, as well as a microphone opening in the wall. To protect the microphone, in particular against contamination, the hearing device has a protective element. Such contamination often passes through the microphone opening into the inner space. "Contamination" herein refers especially to foreign bodies, for example hair and/or moisture, such as, for example, water and/or sweat.

The housing also has a sound channel with at least one sound inlet opening. The sound channel leads from the outside to the microphone, thus forming a sound connection to the microphone opening. To protect the microphone, the protective element is positioned in the sound channel.

For this purpose, the protective element preferably fills the sound channel. The protective element, for this purpose, is in particular flexible and especially elastic. The protective element is in particular deployed so as to be gripped within the sound channel. The protective element therefore has a cross-sectional area that is adapted to the cross-sectional area of the sound channel. The protective element has an outer dimension, i.e. in the case of a circular design a diameter, that is equal to or slightly larger than an inner dimension of the sound channel, in particular an (inner) diameter.

As a result, the microphone is simply and reliably protected from contamination. In addition, the protective element is also protected from being contaminated via direct contact, for example a contaminated finger. For example, upon penetration by a foreign body or moisture, the foreign body or moisture is retained and/or absorbed by the protective element, thus protecting the microphone and prolonging the functionality of the hearing device.

A significant advantage is that as a result of the positioning of the protective element in the sound channel, a height of the hearing device is also reduced, because an existing "space," namely the sound channel, is used for positioning the protective element. In other words: A separate "space" for the protective element in the inner space of the housing is not required, and as a result the height of the housing and thus of the entire hearing device is reduced.

According to a preferred configuration, the protective element is reversibly replaceable. In particular, the protective element is not glued or held by mechanical fasteners. The protective element is preferably present directly in the sound channel and, for example—as already mentioned—gripped in the sound channel by the sound channel itself. As a result, first, a soiled protective element may be straightforwardly renewed. On the other hand, the protective element may thus be produced as a cost-effective user-replaceable part, and in particular long-lived and expensive materials are not required.

Expediently, the sound channel is formed so as to pass through the housing. "Passing through" herein means especially that the sound channel extends from one side of the housing to the other side, for example in the manner of a borehole running through the housing. Each end of the sound channel in this case has a sound inlet opening, with the wall delimiting the sound channel. Sound reaches the microphone via the sound inlet openings and the sound channel. To this end, the microphone is connected with the sound channel via the microphone opening.

Preferably, the microphone opening is oriented transversely to the sound channel, so when the protective element is in the inserted state, it is positioned "in front of" the microphone opening within the sound channel. Preferably, the protective element has a length corresponding to one third of the length of the sound channel.

The sound inlet openings are preferably arranged on opposite side walls of the housing, and when the hearing device is worn, one of the side walls is oriented toward the head. That is, in the worn state, the sound channel is oriented substantially perpendicular to the scalp. As a result, intrusion of contamination such as hair is at least reduced.

First, by means of the sound inlet openings on each end, straightforward replacement of the protective element is ensured. Second, by means of the sound inlet openings, a sufficient "sound pickup" by the microphone is ensured.

Expediently, the protective element is arranged in the sound channel at a distance from the two sound inlet openings, so as to assure protection against contact, for example, by the user's finger. Thus, the protective element is preferably arranged in a middle third of the sound channel, so that when the protective element is in the inserted state, for example, it is positioned one third of the length of the sound channel away from the sound inlet openings. In this way, in particular soiling from contact with the protective element, for example by the user's fingers, is prevented.

For straightforward replacement, according to a preferred embodiment the protective element may be guided through the sound channel. The user may thus accomplish the replacement simply and quickly, for example, by pushing the protective element out of a sound inlet opening of the sound channel and pushing a new protective element in via the respective other sound inlet opening.

The housing is preferably designed to be sealable. According to a preferred development, when the housing is closed, the protective element may be positioned in, and in particular may be pushed into, the sound channel via one of the sound inlet openings. The advantage of this development is in its user-friendliness. Thus, first, as a result of the housing being closed, components of the hearing device are prevented from being damaged and/or lost when replacing the protective element. Second, in this case, there is no need for specialized personnel, for example, an acoustician, in order to replace the protective element.

Preferably, for purposes of replacement, the protective element may be guided into or out of the sound channel by means of a tool. For this purpose, the protective element is pushed out from the sound channel, for example by means of the tool, and a new protective element is then pushed into the sound channel by means of the tool and positioned in front of the microphone opening.

For sound permeability, the protective element is designed in particular as a sound-permeable membrane. In particular, the protective element consists of the membrane. As a result, a sufficient protective effect against foreign bodies and/or moisture is established and in addition, the above-mentioned sound permeability is established, so as not to impact the hearing device functionality. Alternatively, the protective element is formed as a mesh.

In general, the protective element in particular has a shape in the manner of a block or alternatively a cylinder. As a result, it is very well adapted to an inner contour of the sound channel. In general, the protective element preferably has the same cross-sectional area as the sound channel.

In order to ensure the above-described gripping of the protective element in the sound channel, the protective element preferably has a slightly larger outer dimension, especially a diameter, than the inner dimension of the sound channel. A "slightly larger outer dimension" herein means in particular that the outer dimension is greater than the inner dimension of the sound channel by 10% to 20% or, for example, by a value in the range of 0.5 mm to 1.5 mm.

The protective element is preferably self-gripping due to its elastic property. No further means are especially furnished by means of which the gripping of the protective element within the sound channel is ensured.

According to an expedient development, the protective element has a hydrophobic and/or oleophobic material. Alternatively, the protective element is formed of such a material. As a result, the protective element is water- and/or oil-repellent and successfully prevents the penetration of moisture and/or sweat into the housing.

Preferably, the wall has an inner wall region and an outer wall region, between which the sound channel is formed. That is, the sound channel is delimited by the inner wall region and the outer wall region. In other words: The inner wall separates the sound channel from the part of the inner space in which the components of the hearing device and in particular the microphone are arranged. In this case, the outer wall forms the "second boundary" of the sound channel. The inner wall also has a hole in the manner of a borehole, which forms the microphone opening. Between the inner wall and the microphone, a sealing element is preferably arranged. The sealing element preferably serves to further seal the microphone against sound from the inner space.

Another essential aspect in the present case is that the sealing element is preferably free of the protective element. Thus, the sealing element and the protective element are two separate components of the hearing device and accordingly an expensive and complicated sealing element, into which for example the protective element is integrated, is not required. Furthermore, as a result, the overall height of the housing is further reduced, because a sealing element with an integrated protective element has a greater height than the sealing element in this case, which does not have an integrated protective element.

Expediently, the hearing device has a tool as an accessory. The tool has a handle part and at least one tool tip. The handle part serves permits the user to hold the tool when replacing the protective element. The tool tip serves to guide the protective element when it is placed into and positioned inside the sound channel. The advantage is that as a result, the protective element may be straightforwardly replaced.

According to a preferred development, the at least one tool tip has a pin-shaped design and may be pushed into the sound channel, in particular in order to position the protective element. "Pin-shaped" herein means that the diameter of the tool tip is preferably smaller by a factor of 10 than the diameter of the handle part. In particular, the tool tip has the same diameter as the sound channel, to production-related and minimal tolerances. As a result, the tool, in particular, the tool tip may straightforwardly be pushed into the sound channel.

According to a further preferred development, the tool has two tool tips, each having different lengths. This development is based on the idea that the protective element may be pushed out of the sound channel by means of the first—longer—tool tip, and a new protective element may be pushed into the sound channel by means of the second—shorter—tool tip. An essential aspect in this case is that the first—longer—tool tip preferably has at least one length that corresponds to two-thirds of the length of the sound channel. This ensures that the protective element is pushed out of one sound outlet opening when the user introduces the first tool tip into the other sound inlet opening. Analogously, an essential aspect is that the second—shorter—tool tip preferably has at maximum a length that is one-third the length of the sound channel. When the protective element is pushed into the sound channel—i.e. when the second tool tip has been pushed into the sound channel until it stops—it is positioned exactly above the microphone opening.

As a result, the protective element may be straightforwardly replaced and positioned in the sound channel.

According to a preferred configuration, the hearing device is designed as a behind-the-ear (BTE) hearing device.

Other features which are considered as characteristic for the invention are set forth in the appended claims.

Although the invention is illustrated and described herein as embodied in a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 5 is the cross-sectional view taken along the section line III-III shown in FIG. 2 of the hearing device, with a tool introduced into the sound channel to push the protective element in.

DETAILED DESCRIPTION OF THE INVENTION

Figure 1:
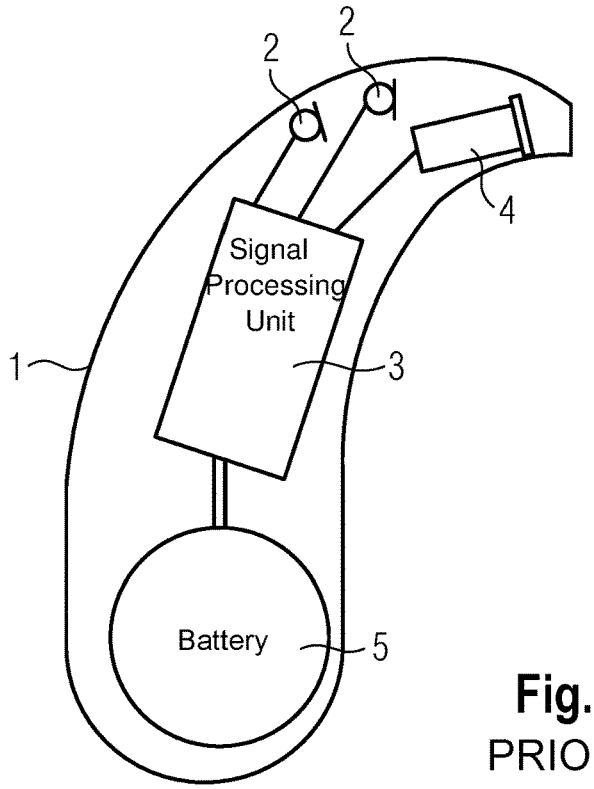
Fig. 1 PRIOR ART
FIG. 1 is a diagrammatic, longitudinal sectional view through a hearing device according to the prior art.

In the drawings, parts having the same effect are represented by the same reference numerals.

Figure 2:
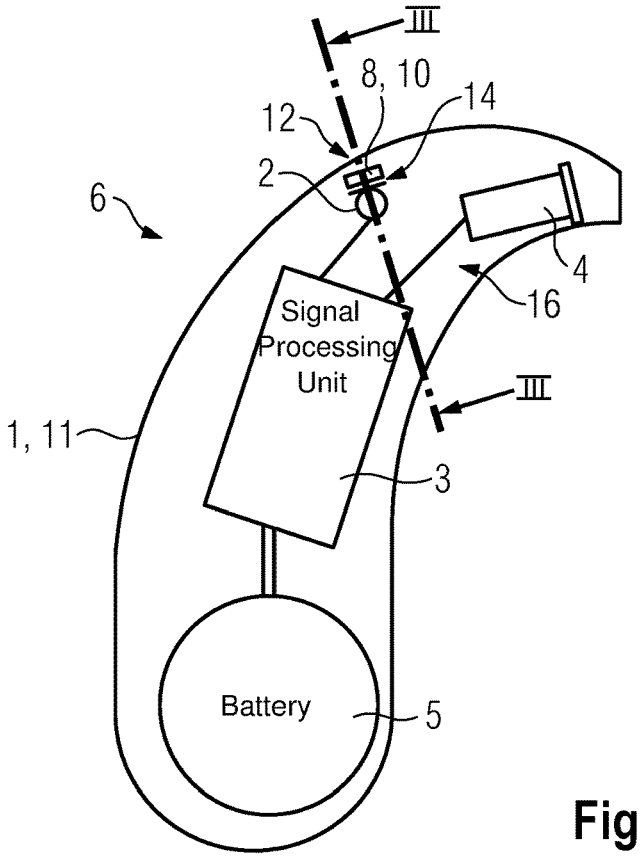
FIG. 2 is a longitudinal sectional view through the hearing device with a sound channel for additionally introducing a protective element according to the invention.

Referring now to the figures of the drawings in detail and first, particularly to FIG. 2 thereof, there is shown a hearing device 6 that has all the parts 1, 2, 3, 4, 5 necessary for the functionality of the hearing device 6 shown in FIG. 1. The hearing device according to FIG. 2 is a behind-the-ear (BTE) hearing device. The hearing device housing 1, or simply the housing 1, has a sound channel 8, which in the exemplary embodiment extends through the housing 1 and has a sound inlet opening 12 at each end. The sound channel 8 is delimited by an outer wall region 12 and an inner wall region 14 of the housing 1. In the exemplary embodiment, the sound channel 8 is arranged such that, when the hearing device 6 is worn, it extends through the housing 1 substantially perpendicular to a scalp 15 of the user oriented. Thus, a sound inlet opening 10 is arranged respectively on each side of the housing 1. In this way, it is prevented, in particular, that a user's hair simply enters the sound channel 8 and thus adversely affects the functionality of the hearing device 6.

The hearing device 6, in particular the housing 1, has an inner space 16 (cf. FIG. 3), in which the components of the hearing device 2, 3, 4, 5 are arranged in the exemplary embodiment, and which is delimited by a wall 11. The inner space 16 is separated from the sound channel 8 by the inner wall region 14. In the exemplary embodiment, a microphone 2 is arranged in the inner space 16 such that the microphone is connected to the sound channel 8 to receive sound via a microphone opening 18 in the inner wall region 14 (see FIG. 3) (preferably in the manner of a borehole). In other words: The microphone 2 is arranged and oriented in the inner space 16 such that sound reaches the microphone 2 via the sound channel 8 and the microphone opening 18.

Figure 3:
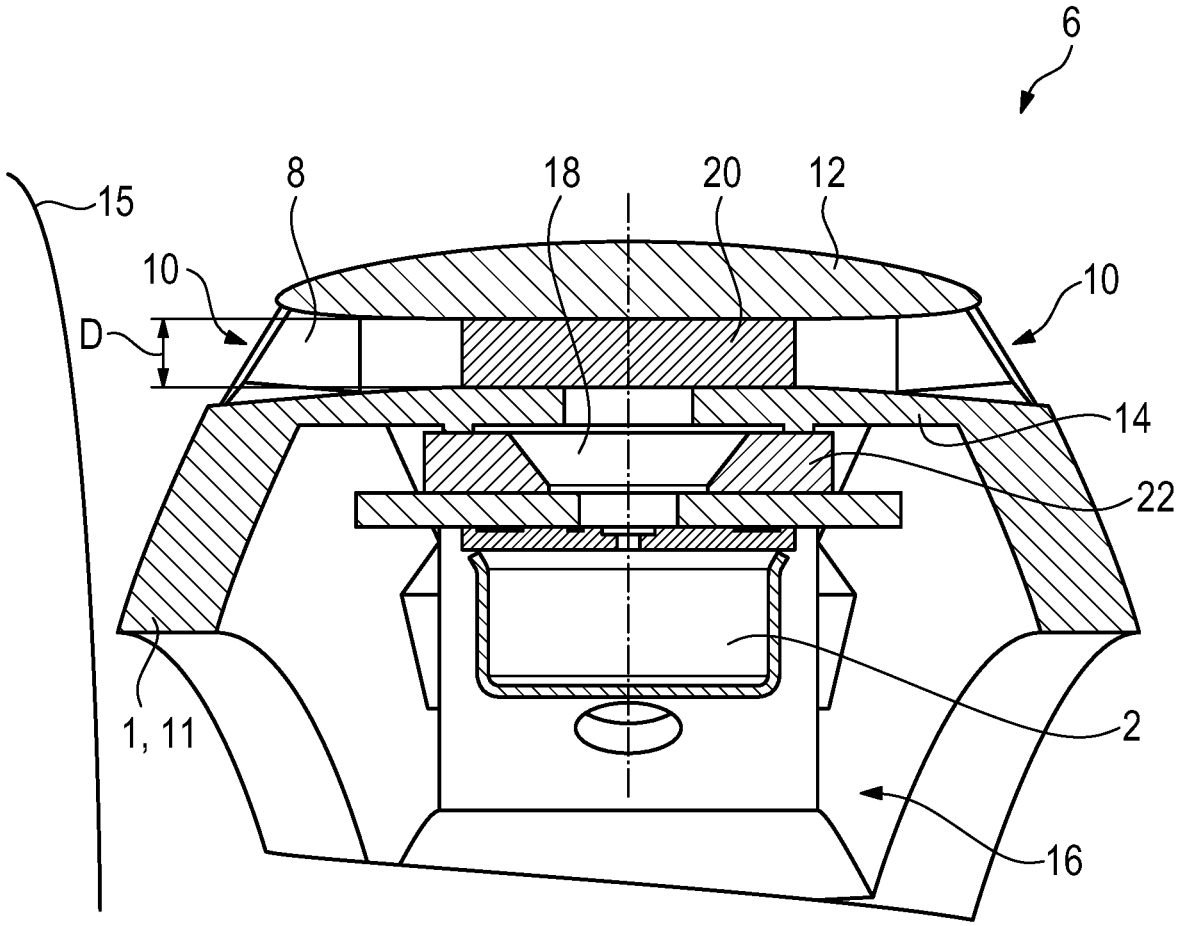
FIG. 3 is a cross-sectional view taken along the section line III-III shown in FIG. 2 of the hearing device with a protective element positioned in the sound channel.

FIG. 3 shows a cross-sectional view through the sectional plane III-III shown in FIG. 2. In the exemplary embodiment, a protective element 20 is positioned in the sound channel 8. The protective element 20 serves to protect the microphone 2 from foreign bodies and contaminants, such as for example moisture. In the inserted state (see FIG. 3), the protective element 20 is positioned in the sound channel 8 in such a way that it seals off the microphone opening 18 and thus prevents the entry of the above-mentioned foreign bodies or contaminants. To establish sound permeability, the protective element 20 is formed as a membrane or alternatively as a mesh, either having a hydrophobic and/or oleophobic material or consisting of such a material. Designing the protective element 20 as a mesh is based on the idea that the protective element 20 thus has a firmness that is "strong" enough to push the protective element 20 in and out of the sound channel 8, but "weak" enough and thus permeable enough to pass sound to the microphone 2. In the exemplary embodiment, the protective element 20 is adapted to the inner contour of the sound channel 8 and has the same cross-sectional contour, in order both to have a high accuracy of fit in the sound channel 8 and also to have a shape that is simple to manufacture, and which in particular favors production as a user-replaceable part. The protective element 20 is, for example, cylindrical or alternatively block-shaped. The element preferably has a length in the direction of the sound channel 8 that is greater than the microphone opening, for example by at least a factor of 2 or at least a factor of 3.

The longitudinal direction of the sound channel 8 and thus that of the protective element 20 is preferably oriented perpendicular to a normal to the surface of the microphone opening 18. The protective element 20 is generally oriented transversely to the microphone opening 18.

To increase the protective effect, the protective element 20 has the same diameter D as the sound channel 8, except for minimal, for example, production-related tolerances.

In the exemplary embodiment, a sealing element 22 is arranged between the inner wall region 14, especially the microphone opening 18, and the microphone 2. The sealing element 22 serves to provide an additional sealing of the microphone opening 18 against sound from the inner space 16.

Figure 4:
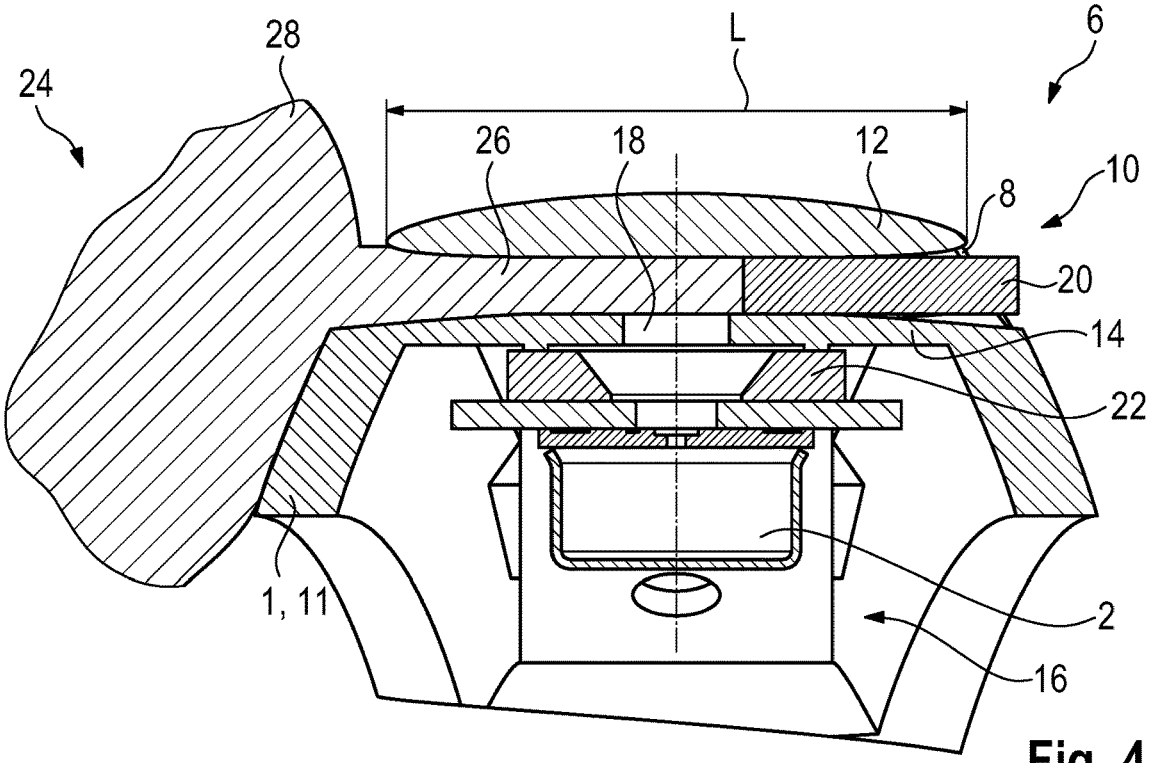
FIG. 4 is the cross-sectional taken along the section line III-III shown in FIG. 2 of the hearing device, with a tool introduced into the sound channel to push the protective element out.

FIG. 4 shows a tool 24 introduced into the sound channel 8, in particular a first tool tip 26 of the tool 24 that has been introduced into the sound channel 8. The tool 24 is used to switch out the protective element 20 from the sound channel 8. For this purpose, for example, the first pin-shaped tool tip 26 is introduced into the sound channel 8 through a sound inlet opening 10 so that the tip "pushes out" the protective element 20 via the opposite sound inlet opening 10 of the continuous sound channel 8. Subsequently, the protective element 20 may be completely removed from the sound channel 8, for example manually, and disposed of. For better handling of the tool 24, it also has a handle part 28 in addition to the first tool tip 26.

To ensure a sufficient "pushing out" of the protective element 20 by means of the first tool tip 26, this tip has at least one length that corresponds to two-thirds of the length L of the sound channel 8.

Figure 5:
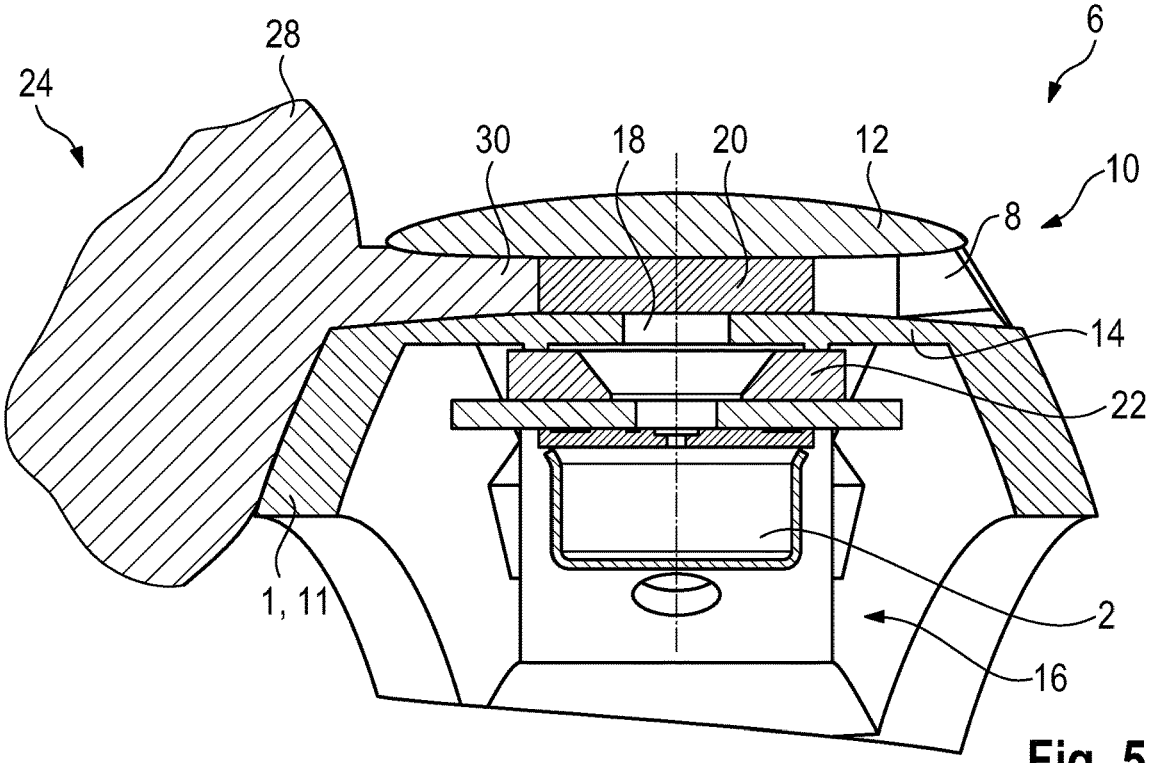

In order to "push in" a new protective element 20 into the sound channel 8, the tool 24 in the exemplary embodiment additionally has a second pin-shaped tool tip 30, as shown in FIG. 5.

The tool tips 26, 30 are arranged, for example, in each case on one (end) side of the handle part 28, so that the user only has to rotate the tool depending on whether the protective element 20 needs to be pushed out or pushed in.

For pushing into the sound channel 8, the user holds the protective element 20, for example, in front of one of the sound inlet openings 10, and then "pushes" it into the sound channel 8 by means of the second tool tip 30. The configuration of the tool 24 with two tool tips 26, 30 has proven suitable because the second tool tip 30, for example, has a length corresponding to one third of the length L of the sound channel 8. In this way, it is straightforwardly ensured that the protective element 20 will always be positioned in front of the microphone opening 18 in the inserted/pushed-in state. In other words: The user pushes the protective element 20 into the sound channel 8 by means of the tool 24 until, for example, the handle part 28 rests against the housing 1. Due to the advantageously selected length of the second tool tip 30, the protective element 20 is then positioned in front of the microphone opening 18 without the user being able to push the protective element 20 too far into the sound channel 8. Alternatively, the tool 24 has only one tool tip.

The invention is not limited to the exemplary embodiments described above. Rather, other variants of the invention may be derived therefrom by a person of ordinary skill in the art without departing from the subject matter of the invention. In particular, all the individual features described in connection with the exemplary embodiment may also be combined with each other in other ways, without departing from the subject matter of the invention.

The following is a summary list of reference numerals and the corresponding structure used in the above description of the invention:

1 Hearing device housing
2 Microphone
3 Signal processing unit
4 Receiver
5 Battery
6 Hearing device
8 Sound channel
10 Sound inlet opening
11 Wall
12 Outer wall region
14 Inner wall region
15 Scalp of the user
16 Inner space
18 Microphone opening
20 Protective element
22 Sealing element
24 Tool
26 First tool tip
28 Handle part
30 second tool tip
D Diameter of the sound channel
L Length of the sound channel

The invention claimed is:

1. A hearing device, comprising:
a housing having a wall that delimits an inner space, said wall having a microphone opening formed therein;
a microphone disposed in said inner space;
a protective element for protecting said microphone;
said housing having a sound channel that leads to said microphone and at least one sound inlet opening formed therein, said protective element is disposed in said sound channel;
said wall having an inner wall region and an outer wall region delimiting said sound channel, said sound channel extending in a sound channel direction:
said microphone opening being oriented transversely to said sound channel;
said inner wall region having a hole formed therein forming said microphone opening;
said protective element being elastic and being gripped within said sound channel as a result of its elasticity;
said protective element being reversibly replaceable in said sound channel and said protective element configured to be pushed in the sound channel direction into said sound channel via said sound inlet opening.

2. The hearing device according to claim 1, wherein said sound channel is configured to extend through said housing and has a respective sound inlet opening formed at each end, said sound channel being delimited by said wall and connected to said microphone via said microphone opening.

3. The hearing device according to claim 2, wherein said housing is a sealable housing, and when said housing is closed, said protective element may be placed into said sound channel via one said sound inlet opening.

4. The hearing device according to claim 1, wherein said protective element is disposed in said sound channel a distance apart from said at least one sound inlet opening.

5. The hearing device according to claim 1, wherein said protective element may be guided through said sound channel.

6. The hearing device according to claim 1, wherein for purposes of replacement, said protective element may be guided into or out of said sound channel by means of a tool.

7. The hearing device according to claim 1, wherein said protective element is a membrane.

8. The hearing device according to claim 1, wherein said protective element has a hydrophobic and/or oleophobic material.

9. The hearing device according to claim 1,
further comprising a sealing element disposed between said microphone and said inner wall.

10. The hearing device according to claim 9, wherein said sealing element is separate from said protective element.

11. The hearing device according to claim 1, wherein the hearing device is a behind-the-ear hearing device.

12. A hearing device, comprising:

a housing having a wall that delimits an inner space, said wall having a microphone opening formed therein;

a microphone disposed in said inner space;

a protective element for protecting said microphone;

said housing having a sound channel that leads to said microphone and at least one sound inlet opening formed therein, said protective element is disposed in said sound channel; and a tool as an accessory, said tool having a handle part and at least one tool tip for guiding said protective element.

13. The hearing device according to claim 12, wherein said at least one tool tip is pin-shaped and may be pushed into said sound channel.

14. The hearing device according to claim 12, wherein said at least one tool tip is one of two tool tips that are furnished having different lengths.

* * * * *